US010498075B2

(12) United States Patent
Yamanaka et al.

(10) Patent No.: US 10,498,075 B2
(45) Date of Patent: Dec. 3, 2019

(54) CONNECTOR

(71) Applicant: Sumitomo Wiring Systems, Ltd., Yokkaichi, Mie (JP)

(72) Inventors: Wataru Yamanaka, Mie (JP); Hidefumi Horiuchi, Mie (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 16/067,633

(22) PCT Filed: Jan. 6, 2017

(86) PCT No.: PCT/JP2017/000220
§ 371 (c)(1),
(2) Date: Jul. 2, 2018

(87) PCT Pub. No.: WO2017/126334
PCT Pub. Date: Jul. 27, 2017

(65) Prior Publication Data

US 2019/0006792 A1 Jan. 3, 2019

(30) Foreign Application Priority Data

Jan. 21, 2016 (JP) ..... 2016-009478

(51) Int. Cl.
*H01R 13/627* (2006.01)
*H01R 13/64* (2006.01)

(52) U.S. Cl.
CPC ..... *H01R 13/6272* (2013.01); *H01R 13/64* (2013.01)

(58) Field of Classification Search
CPC ..... H01R 13/639; H01R 13/6272; H01R 13/641; H01R 13/64; H01R 13/4367;
(Continued)

(56) References Cited

U.S. PATENT DOCUMENTS 6,109,955 A * 8/2000 Hanazaki ..... H01R 13/641 439/352
6,234,826 B1 * 5/2001 Wilber ..... H01R 13/4368 439/352

(Continued)

FOREIGN PATENT DOCUMENTS

| | | |
|---|---|---|
| JP | 8-321352 | 12/1996 |
| JP | 3419602 | 4/2003 |
| JP | 4725500 | 4/2011 |

OTHER PUBLICATIONS

International Search Report dated Mar. 21, 2017.

*Primary Examiner* — James Harvey
*Assistant Examiner* — Matthew T Dzierzynski
(74) *Attorney, Agent, or Firm* — Gerald E. Hespos; Michael J. Porco; Matthew T. Hespos

(57) ABSTRACT

A housing (10) includes a lock arm (31) for resiliently connecting and holding a mating housing (90). A detector (60) is movable to a standby position and a detection position with respect to the lock arm (31), and includes a resilient arm (62) to be resiliently locked by the lock arm (31) at the standby position. The lock arm (31) includes colliding portions (43) arranged at both sides of a front part of the resilient arm (62) and projecting farther forward than a front end of the resilient arm (62) and configured to contact a wall surface of the housing (10) or the mating housing (90) by a resilient returning movement of the lock arm (31) when the detector (60) is at the detection position.

5 Claims, 6 Drawing Sheets

(58) Field of Classification Search
CPC .... H01R 13/4368; H01R 13/44; H01R 13/52; H01R 13/6275; H01R 13/62927; H01R 13/642
See application file for complete search history.

(56) References Cited

U.S. PATENT DOCUMENTS

| | | | | |
|---|---|---|---|---|
| 6,468,105 | B2 * | 10/2002 | Noguchi | H01R 13/4367 439/352 |
| 6,824,417 | B1 * | 11/2004 | Nimura | H01R 13/641 439/352 |
| 6,896,538 | B2 * | 5/2005 | Grubbs | H01R 13/52 439/352 |
| 7,048,568 | B2 * | 5/2006 | Fisher | H01R 13/6272 439/352 |
| 8,926,355 | B2 * | 1/2015 | Heil | H01R 13/641 439/352 |
| 9,054,458 | B1 * | 6/2015 | Ng | H01R 13/641 |
| 9,484,684 | B2 * | 11/2016 | Tanikawa | H01R 13/6275 |
| 9,543,702 | B2 * | 1/2017 | Horiuchi | H01R 13/639 |
| 10,038,278 | B2 * | 7/2018 | Lane | H01R 13/6272 |
| 10,109,953 | B2 * | 10/2018 | Schmidt | H01R 13/6272 |

* cited by examiner

CONNECTOR

BACKGROUND

Field of the Invention.

The present invention relates to a connector.

Description of the Related Art.

Japanese Unexamined Patent Publication No. H08-321352 discloses a connector that includes a female connector and a male connector that are connectable to each other. The male connector includes a claw-like engaging projection on an outer wall of a receptacle. The female connector includes a seesaw-like lock arm at a position facing the engaging projection. The lock arm has a striking margin to move resiliently over the engaging projection and be struck against the outer wall of the receptacle on a back side of the engaging projection when the connectors are connected properly. This striking margin is formed by padding an inner surface of a hook on a tip part of the lock arm.

A connected state can be determined by auditory detection of a connection sound (locking sound, colliding sound) caused by the striking margin, and a detecting member may be adopted to check whether or not the connectors have been connected properly. The detecting member normally is arranged movably between a standby position and a detection position with respect to the lock arm. More particularly, the connecting member is configured to be left at the standby position in the process of connecting the connectors but is movable to the detection position when the connectors are connected properly. However, the padding of the inner surface of the hook can cause the lock arm to warp and deform so that the hook inclines up toward the front when the connectors are connected properly. Thus, the detecting member cannot move smoothly from the standby position to the detection position on the upper surface of the lock arm, thereby causing a problem that the mechanical detection technique by the detecting member cannot be adopted.

The invention was completed on the basis of the above situation and aims to provide a connector capable of generating satisfactory connection sound, having a detecting member movably arranged on a lock arm and capable of improving the reliability of connection detection.

SUMMARY

The invention is directed to a connector with a housing including a resilient lock arm for connecting and holding a mating housing. A detector is arranged movably with respect to the lock arm between a standby position and a detection position before the standby position. The detector includes a resilient arm to be locked by the lock arm at the standby position. The resilient arm and the lock arm are unlocked when the housing is connected properly, thereby enabling a movement to the detection position. The lock arm includes a colliding portion arranged at both sides of a front end part of the resilient arm. The colliding portion projects farther forward than a front end of the resilient arm and is configured to contact a wall surface of the housing or the mating housing by a resilient returning movement of the lock arm when the detecting member is at the detection position.

When the housing is connected properly, the lock arm resiliently returns and the colliding portion contacts the wall surface of the housing or the mating housing to produce a connection sound. The connection sound provides an audible detection that the housings have been connected properly. The colliding portion is sized to project farther forward than the front end of the resilient arm when the detector is at the detection position. Therefore, a sufficient striking margin (hitting area) to strike the wall surface can be ensured in a front-rear direction. Thus, satisfactory connection sound can be generated even without enlarging the striking margin in a deflecting direction of the lock arm, and the lock arm will not warp and deform. As a result, the detector can move smoothly from the standby position to the detection position with respect to the lock arm and both mechanical detection of the detector and auditory detection of the colliding portion can be exhibited satisfactorily. Further, the colliding portion is arranged at both sides of the front end part of the resilient arm and projects farther forward than the front end of the resilient arm. Thus, the front part of the resilient arm is protected from both sides by the colliding portion and external matter cannot interfere with the front end part of the resilient arm in a manner that could inadvertently unlock the resilient arm from the lock arm.

The detector may include a guide arranged at both sides of the resilient arm and configured to embrace both sides of the lock arm. The colliding portion may be between the guide and the resilient arm at the detection position. According to this configuration, the resilient arm is protected more reliably by the guide and the colliding portion.

DETAILED DESCRIPTION

Figure 1:
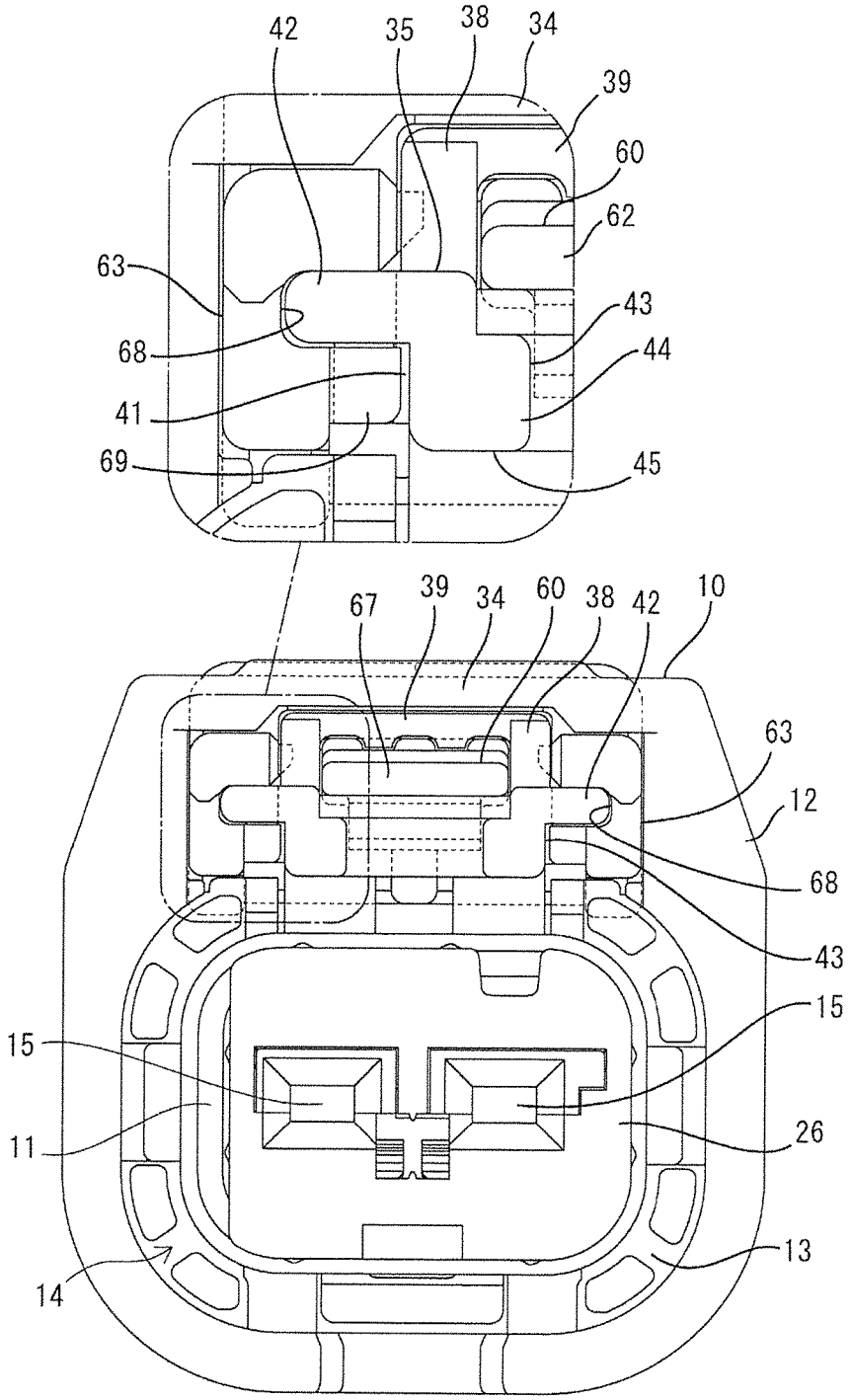
FIG. 1 is a front view and a partial enlarged view of a connector according to one embodiment of the present invention.

A connector of one embodiment includes a housing 10 and a detector 60. The housing 10 is connectable to a mating housing 90. The detector 60 is mounted in the housing 10 movably between a standby position and a detection position. Note that, in the following description, sides of the housings 10, 90 facing each other when connection is started are referred to as the fronts concerning a front-rear direction. A vertical direction is based on figures except FIGS. 4 and 6.

The mating housing 90 is made of synthetic resin and includes a tubular receptacle 91 projecting forward. A lock 92 projects on the upper surface of an upper wall of the receptacle 91. The front surface of the lock 92 is inclined rearwardly toward a projecting end, and the rear surface thereof is formed into a claw shape substantially extending along the vertical direction. Male tabs 96 of mating terminal fittings 95 project into the receptacle 91.

The housing 10 is made of synthetic resin and includes, as shown in FIG. 1, a block-like housing body 11, a fitting tube 12 surrounding the outer periphery of the housing body 11, and a radially extending coupling 13 coupling the fitting tube 12 and the housing body 11. A space between the housing body 11 and the fitting tube 12 and forward of the coupling 13 serves as a connection space 14 into which the receptacle 91 of the mating housing 90 is fit. Cavities 15 penetrae the housing body 11 in the front-rear direction.

Each cavity 15 includes a resilient locking lance 16 projecting forward on the lower surface of an inner wall.

Figure 2:
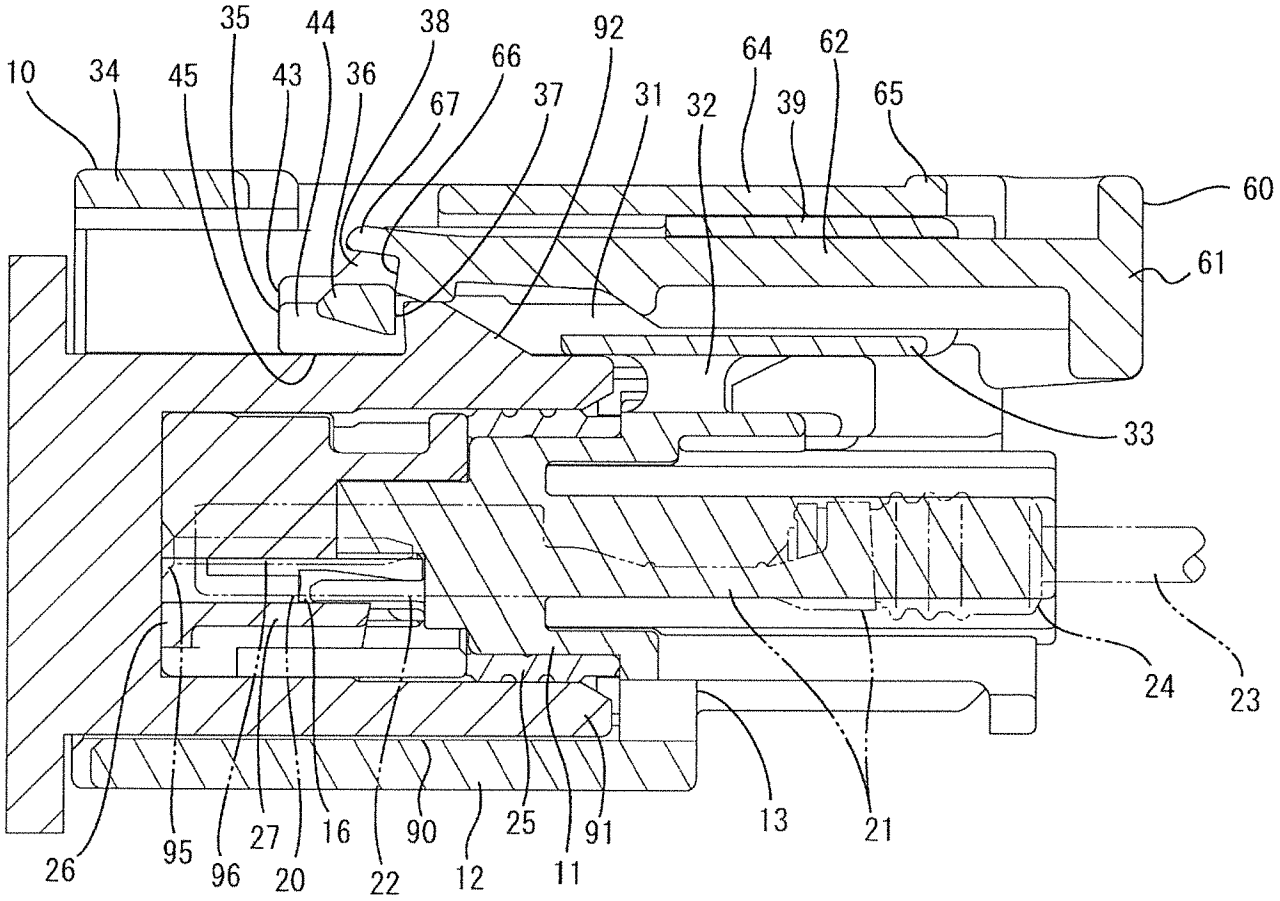
FIG. 2 is a section showing a state where locking of a detector at a standby position with respect to a lock arm is released when both housings are properly connected.

A terminal fitting 20 is inserted into each cavity 15 from behind. The terminal fitting 20 is locked resiliently by the locking lance 16 and retained in the cavity 15. As shown in FIG. 2, the terminal fitting 20 includes an open barrel 21 and a tubular connecting portion 22. The barrel 21 is crimped and connected to an end part of a wire 23 and a rubber plug 24. The connecting portion 22 is located in front of the barrel 21 and is connected conductively to the mating terminal fitting 95 when the housings 10, 90 are connected properly. Note that when the terminal fitting 20 is inserted properly into the cavity 15, the rubber plug 24 is held resiliently in close contact with the inner peripheral surface of the cavity 15 and the wire 23 is pulled to the outside from the rear surface of the housing body 11.

As shown in FIG. 2, a seal ring 25 is fit on the outer peripheral surface of the housing body 11. The seal ring 25 is sandwiched resiliently between the housing body 11 and the receptacle 91 when the housings 10, 90 are connected properly. The front surface of the housing body 11 is covered by a front retainer 26. The front retainer 26 includes retaining portions 27 projecting rearward. When the front retainer 26 is mounted properly onto the housing body 11, the retaining portions 27 enter deflection spaces for the locking lances 16 and the terminal fittings 20 are retained secondarily in the cavities 15. Further, the rear end of the front retainer 26 is arranged to contact the seal ring 25 and to retain the seal ring 25 on the housing body 11.

The housing 10 is provided with a lock arm 31. The lock arm 31 includes a leg 32 rising from the upper surface of the housing body 11 and an arm 33 projecting both forward and rearward from the upper end of the leg 32. The arm 33 is resiliently displaceable (tiltably displaceable) in a seesaw manner with the upper end of the leg 32 as a support. Note that a front part of the upper wall of the fitting tube 12 has a bridge 34 extending along a width direction provided, and a part of this upper wall facing the lock arm 31 is open, leaving the bridge 34.

Figure 4:
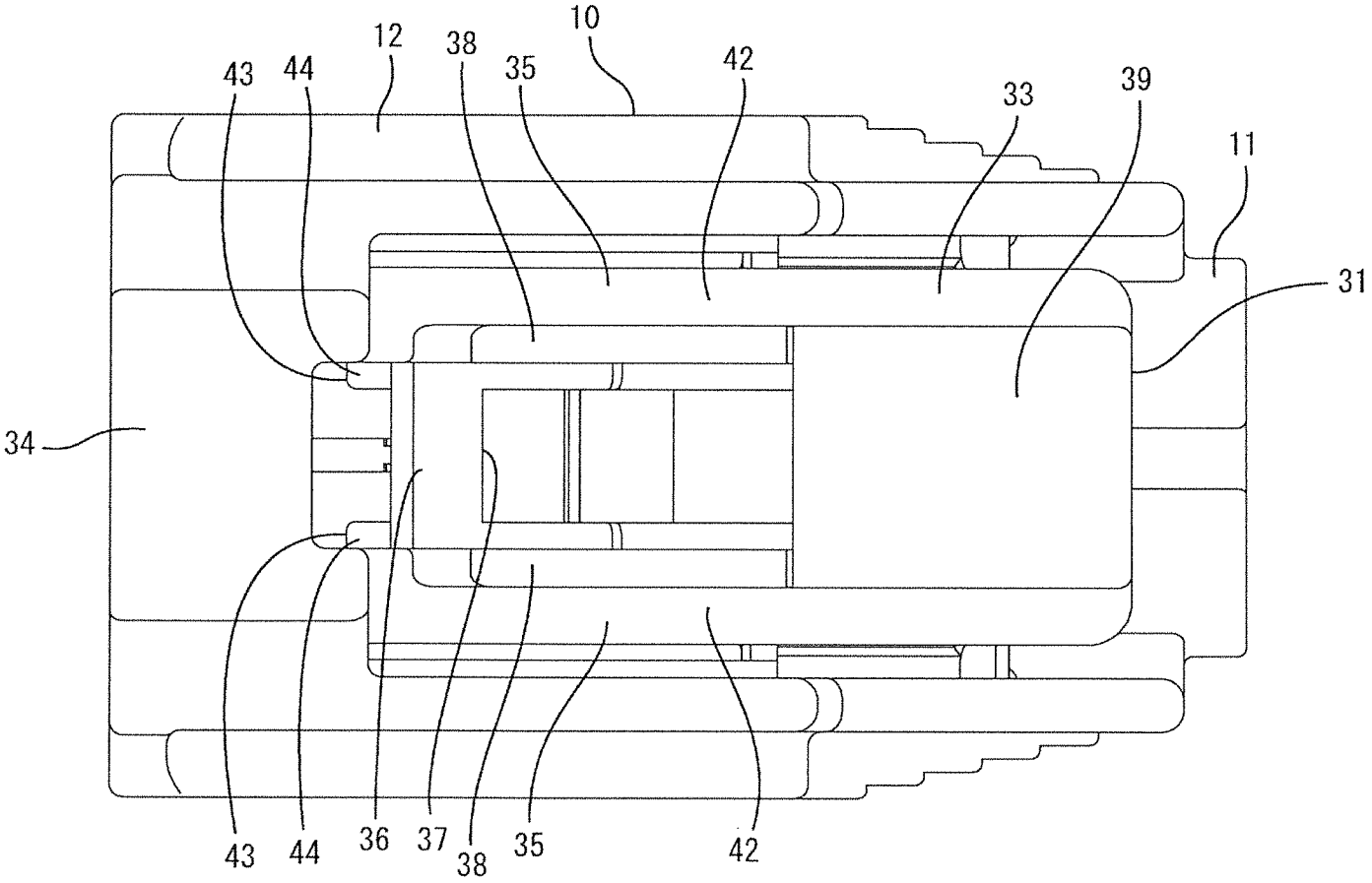
FIG. 4 is a plan view of the housing.

As shown in FIG. 4, the arm 33 includes two parallel extending portions 35 extending in the front-rear direction, and a lock body 36 is bridged between front end parts of the extending portions 35. A rearwardly open lock hole 37 penetrating in the vertical direction and open rearward is provided between the extending portions 35 and the lock body 36 and vertically penetrates the arm 33. The extending portions 35 are substantially rectangular bars long and narrow in the front-rear direction. The lock body portion 36 is arranged along the width direction to close the front end of the lock hole 37.

As shown in FIGS. 1 and 4, two protection walls 38 stand on the upper surface of th extending portions 35. The protection walls 38 are in the form of plates extending in the front-rear direction along both side edges of the lock hole 37. The front ends of the protection walls 38 are arranged substantially at the same position as the lock body 36 in the front-rear direction.

A flat rectangular plate 39 is bridged between the upper ends of rear parts of the protection walls 38. The flat plate 39 is arranged to cover a rear part of the lock hole 37 from above. Two stoppers 41 are provided on lower parts of outer side surfaces of the extending portions 35 (see FIG. 1). The stoppers 41 project laterally from intermediate positions of the outer side surfaces of the extending portions 35 in the front-rear direction.

Two rails 42 are provided on upper parts of the outer side surfaces of the extending portions 35. The rails 42 are in the form of plates protruding laterally from the outer side surfaces of the extending portions 35 and extend in the front-rear direction over the entire lengths of the extending portions 35.

The lock body 36 is retracted rearwardly from the front ends of the extending portions 35 and the rails 42 (see FIGS. 2 and 4). In other words, front end parts of the extending portions 35 and the rails 42 project farther forward than the front end of the lock body 36.

As shown in FIG. 1, the front ends of the extending portions 35 are formed respectively as colliding portions 43. Each colliding portion 43 incudes a padding portion 44 in the form of a rectangular block on a lower part of the inner side surface of the front end of the extending portion 35. An upper part of the inner side surface of the front end of the extending portion 35 and the upper surface of the padding portion 44 form an L-shaped cross-section and are connected substantially at a right angle.

Both inner and outer side surfaces of the colliding portion 43 are arranged along the vertical direction. An upper end part of the outer side surface of the colliding portion 43 is coupled integrally to the rail 42, and the front end of the colliding portion 43 is arranged substantially at the same position as the front end of the rail 42 in the front-rear direction. The bottom of the colliding portion 43 forms a flat colliding surface 45 extending along the front-rear direction and the width direction. The colliding portion 43 is configured to generate connection sound by coming into substantially surface contact with the upper surface of the upper wall of the receptacle 91 as the lock arm 31 resiliently returns when the housings 10, 90 are connected properly. In this case, the colliding surface 45 of the colliding portion 43 is enlarged in the front-rear direction and the width direction and large connection sound can be generated by as much as the padding portion 44. Thus, even if a large striking margin by which the upper wall of the receptacle 91 and the colliding portions 43 overlap in the vertical direction (deflecting direction of the lock arm 31) is not ensured, satisfactory connection sound can be generated.

Figure 5:
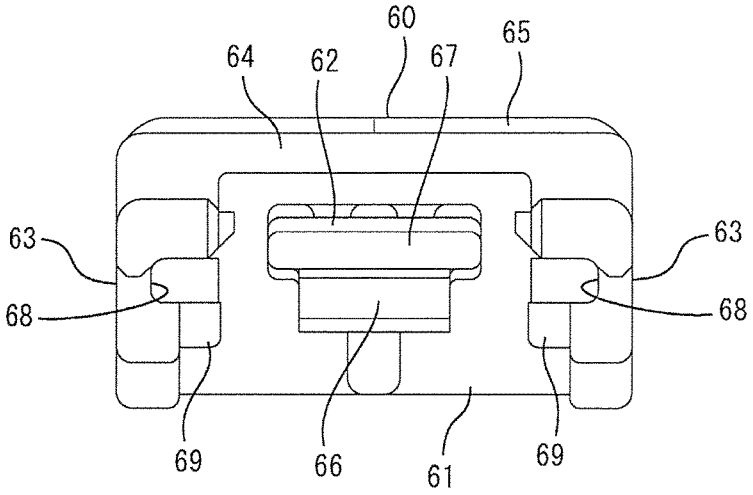
FIG. 5 is a front view of the detector.
Figure 6:
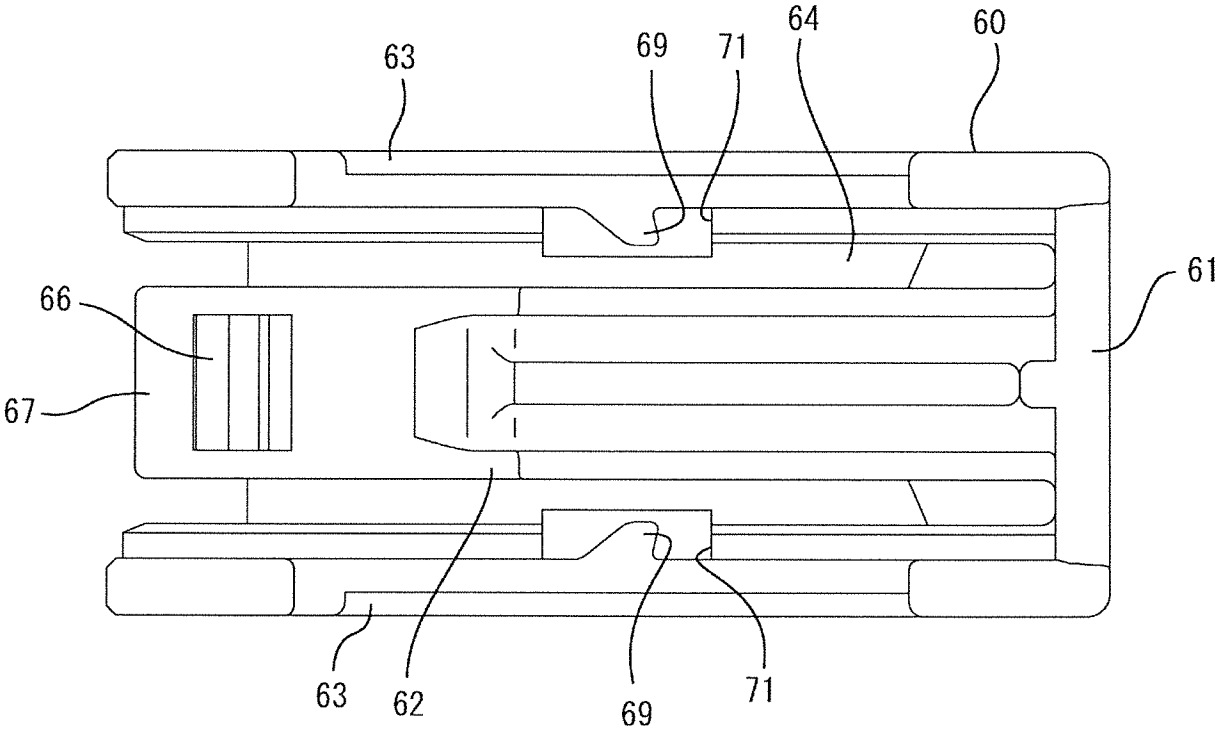
FIG. 6 is a bottom view of the detector.

The detector 60 is made of synthetic resin and includes, as shown in FIGS. 5 and 6, a back plate 61 rectangular in a front view, a resilient arm 62 extending forward from a substantially central part of the front surface of the back plate 61, two guides 63 extending forward from both end parts of the front surface of the back plate 61 and a covering plate 64 bridged between the upper ends of the guides 63. The detector 60 can be inserted into the lock hole 37 of the lock arm 31 from behind and pushed forward to reach the detection position from the standby position relatively rearward of the arm 33.

The covering plate 64 is rectangular in a plan view and includes an operating portion 65 arranged to be slightly higher on a rear end part of an upper surface. A worker can move the detector 60 while pressing his fingers against the operating portion 65

The resilient arm 62 is deflectable and deformable in the vertical direction with a location near the back plate 61 as a support. As shown in FIG. 6, a front part of the resilient arm 62 is arranged to project farther forward than the front end of the covering plate 64. The front part of the resilient arm 62 includes a lock projection 66 on a lower surface. The lock projection 66 is a rectangular block having both front and rear surfaces extending substantially along the vertical direction. Further, the resilient arm 62 includes a pressing piece 67 in the form of a plate projecting farther forward than the lock projection 66.

Similar to the resilient arm 62, front end parts of the both guides 63 project farther forward than the front end of the covering plate 64. The front ends of the guides 63 are located slightly more forward than the front end of the resilient arm 62. As shown in FIG. 5, the guides 63 include rail grooves 68 on inner side surfaces. Each rail groove 68 is recessed in the inner side surface of the guide portion 63 to have a substantially U-shaped cross-section, extends in the front-rear direction and is open in the front end surface of the guide 63. Further, each guide 63 includes a locking projection 69 at intermediate positions of lower end parts of the inner side surfaces in the front-rear direction. The front surface of the locking projection 69 is inclined rearwardly toward a projecting end, and the rear surface thereof is formed into a claw shape slightly inclined rearwardly toward the projecting end. Two window hole 71 are provided in both side parts of the covering plate 64 due to the pull-out of an unillustrated mold for forming the locking projections 69. The locking projections 69 can be confirmed visually from above through the window holes 71.

Next, a connection method of the connectors, a detection method of the detector 60 and the like are described.

First, the detector 60 is assembled with the lock arm 31 of the housing 10. When the detector 60 is inserted into the lock hole 37 of the lock arm 31 from behind, the rails 42 of the lock arm 31 are fit into the rail grooves 68 of the guides 63 and the lock arm 31 is embraced by the detector 60. Further, the flat plate 39 of the lock arm 31 is sandwiched between the resilient arm 62 and the covering plate 64 (see FIG. 2). When the detector 60 reaches the standby position, thelocking projections 69 resiliently move over the stoppers 41 and the rear surfaces thereof are arranged to face and lock the front surfaces of the stoppers 41 (see FIG. 1). Further, at the standby position, the pressing piece 67 of the resilient arm 62 is placed on the upper surface of the lock body 36 and the front surface of the lock projection 66 is arranged to face and lock the rear surface of the lock body 36 (also the front surface of the lock hole 37). In this way, the detector 60 is held at the standby position with movements in the front-rear direction restricted. When the detector 60 is at the standby position, the operating portion 65 of the detector 60 projects farther rearward than the rear end of the housing body 11.

Subsequently, the mating housing 90 is fit into the connection space 14 of the housing 10. In a final stage of the connecting process, the lock 92 of the mating housing 90 interferes with the lock body 36 of the lock arm 31 and the lock arm 31 is deflected and deformed resiliently. When the housings 10, 90 are connected properly, the lock 92 moves over the lock body 36 and the lock arm 31 is displaced resiliently in a returning direction. At this time, the front end of the arm 33 is displaced down, and the colliding surfaces 45 of the colliding portions 43 collide with the upper surface of the upper wall of the receptacle 91 to generate connection sound (locking sound, colliding sound) while the lock arm 31 is biased to return. At this time, a deflected state of the lock arm 31 is substantially eliminated and the arm 33 returns to a natural state to extend substantially straight in the front-rear direction.

Further, when the lock arm 31 resiliently returns, the lock 92 is inserted into the lock hole 37 from below, as shown in FIG. 2, and, associated with that, the lock projection 66 of the detector 60 is pushed up by the lock 92 and the resilient arm 62 is deflected and deformed to unlock the lock projection 66 and the lock body 36. In this way, the detector 60 is set in a state movable to the detection position.

Subsequently, the detector 60 is pushed forward toward the detection position and linearly slid along the extending portions 35 of the lock arm 31. In the process of the detector 60 moving toward the detection position, the rail grooves 68 of the guides 63 slide along the rails 42 of the lock arm 31, thereby ensuring a state where the detector 60 moves linearly. Further, the lock projection 66 of the resilient arm 62 slides on the upper surface of the lock body 36 to maintain a deflected state of the resilient arm 62.

Figure 3:
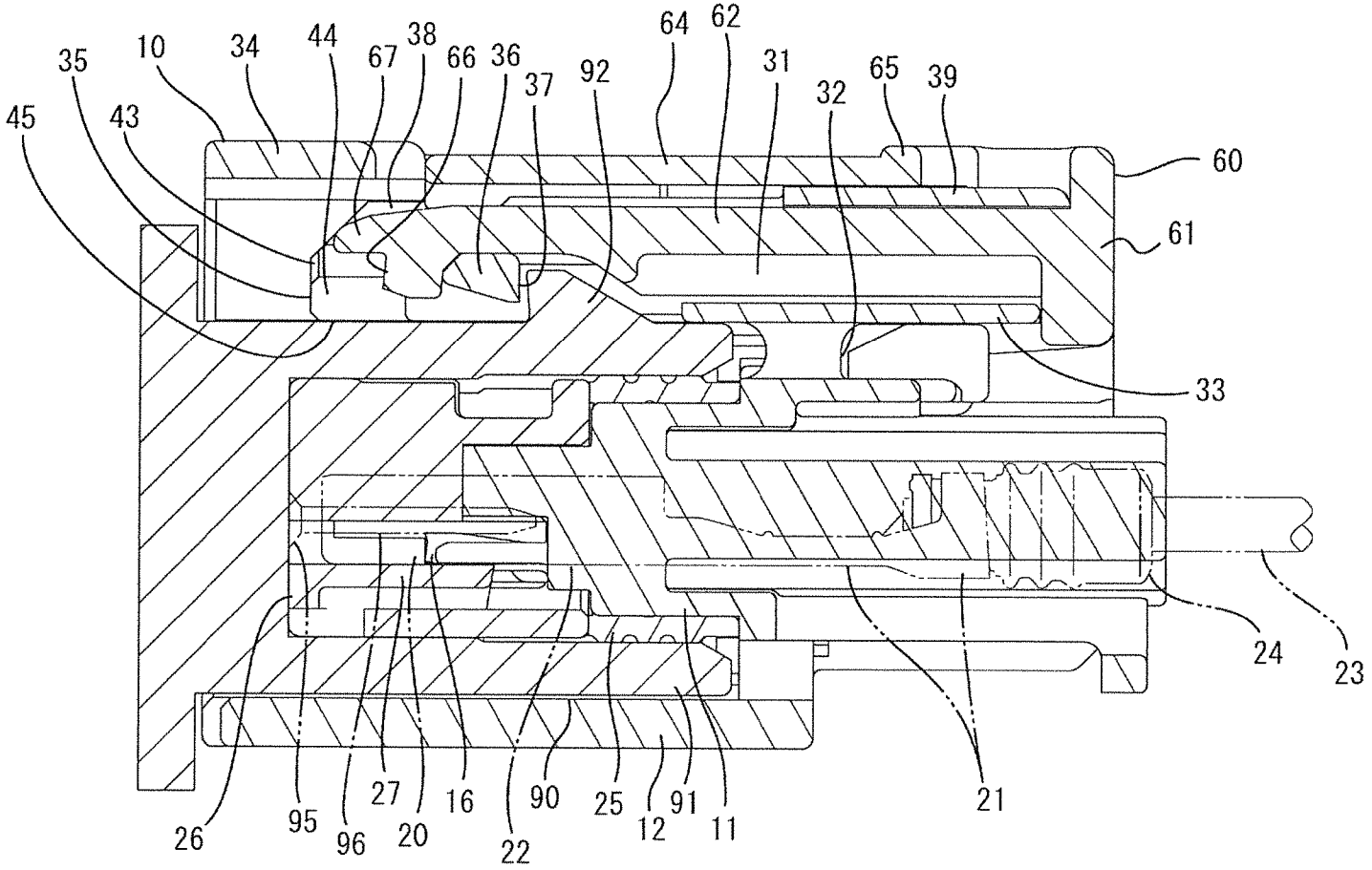
FIG. 3 is a section showing a state where the detector is at a detection position.

When the detector 60 reaches the detection position, the lock projection 66 moves over the lock body 36, the resilient arm 62 resiliently returns and the rear surface of the lock projection 66 is arranged to face and lock the front surface of the lock body 36, as shown in FIG. 3. In this way, a returning movement of the detector 60 from the detection position to the standby position is restricted. Further, a further forward movement of the detector 60 beyond the detection position is restricted by the contact of the front end of the covering plate 64 with the rear end of the bridge 34. With the detector 60 held at the detection position with respect to the lock arm 31 in this way, the operating portion 65 is located forward of the rear end of the housing body 11 and the upper surface of the flat plate 39 is exposed behind the operating portion 65.

On the other hand, unless the housings 10, 90 are connected properly, locking between the lock projection 66 and the lock body 36 is maintained. Thus, the detector 60 cannot be moved to the detection position. Therefore, the housings 10, 90 can be judged to have been properly connected if the detector 60 is movable to the detection position.

When the detector 60 is at the detection position, the colliding portions 43 of the lock arm 31 are arranged at both sides of the front part of the resilient arm 62 in the width direction and the front ends thereof are located forward of the front end of the resilient arm 62 (see FIG. 3). The padding portions 44 of the colliding portions 43 have parts arranged to proximately face to both sides of the lock projection 66 in the width direction and projecting farther forward than the front end of the lock projection 66.

Further, both outer sides of the front part of the resilient arm 62 are covered by the front end parts of the extending portions 35 and both outer sides of the front end parts of the extending portions 35 are covered by the front end parts of the guides 63. In other words, the front parts (including the colliding portions 43) of the extending portions 35 are sandwiched between the front part of the resilient arm 62 and the front parts of the guides 63.

As just described, in this embodiment, the colliding portions 43 can generate connection sound by striking the upper surface of the upper wall of the receptacle 91 as the lock arm 31 resiliently returns, thereby enabling audibly detection that the housings 10, 90 have been connected properly. Further, it also can be detected mechanically that the housings 10, 90 have been connected properly if the detector 60 becomes movable to the detection position. In this case, since the colliding portions 43 project farther forward than the front end of the resilient arm 62 and the padding portions 44 are provided on the inner side surfaces of the extending portions 35, the colliding surfaces 45 of the colliding portions 43 expand in planar directions (front-rear direction and width direction) and large connection sound can be generated. Thus, it is not necessary to ensure large striking margins (overlapping margins) in the deflecting direction of the lock arm 31 (vertical direction) between the upper wall of the receptacle 91 and the colliding portions 43, and the lock arm 31 can be in a straight posture along the front-rear direction when resiliently returning and locking the lock 92. Therefore, the detector 60 can move smoothly straight along the lock arm 31 when moving from the standby position to the detection position. As a result, the smoothness of the moving operation of the detector 60 is ensured.

Further, the colliding portions 43 are arranged at both sides of the front end part of the resilient arm 62 in the width direction and the front ends of the colliding portions 43 are located forward of the front end of the resilient arm 62. Thus, the front end part of the resilient arm 62 is protected from both left and right sides in the width direction by the colliding portions 43. As a result, it can be prevented that external matter interferes with the front end part of the resilient arm 62 to inadvertently unlock the lock projection 66 and the lock body 36.

Furthermore, when the detector 60 is at the detection position, the colliding portions 43 are arranged laterally outward of the front end part of the resilient arm 62 and the guides 63 are arranged laterally outward of the colliding portions 43. Thus, the front end part of the resilient arm 62 is protected more reliably from both sides in the width direction.

Other embodiments of the invention are described briefly below.

The colliding portions of the lock arm may generate connection sound by coming into contact with a wall surface of the housing when the both are connected properly.

The detector may automatically reach the detection position by being biased by a spring as the housings are connected properly.

LIST OF REFERENCE SIGNS

10 . . . housing
11 . . . housing body
31 . . . lock arm
33 . . . arm
35 . . . extending portion
43 . . . colliding portion
60 . . . detector
62 . . . resilient arm
63 . . . guide
90 . . . mating housing
91 . . . receptacle
92 . . . lock

The invention claimed is:

1. A connector, comprising:

a housing including a front end configured for connection to a mating housing, a lock arm cantilevered forward on the housing and configured for resiliently holding a lock projecting out from an outer surface on the mating housing; and a detector arranged movably with respect to the lock arm between a standby position and a detection position, the detector including a resilient arm with in inwardly projecting lock projection to be resiliently locked by the lock arm at the standby position, the resilient arm and the lock arm being unlocked when the housing and the mating housing are connected properly, thereby enabling a movement to the detection position;

wherein the lock arm includes colliding portions arranged at both sides of a front end part of the resilient arm and projecting farther forward than a front end of the resilient arm and configured to come into contact with an external wall surface of the mating housing by a resilient returning movement of the lock arm when the detector is at the detection position.

2. The connector of claim 1, wherein the detector includes guides arranged at opposite respective sides of the resilient arm and configured to embrace both sides of the lock arm, and the colliding portion is located between the guides and the resilient arms at the detection position.

3. The connector of claim 1, wherein the lock arm includes two forwardly cantilevered extending portions and a lock body bridged between the extending portions, the colliding portions being formed respectively on the extending portions and projecting forward of the lock body.

4. The connector of claim 3, wherein the colliding portions project inwardly and toward one another from the extending portions.

5. The connector of claim 1, wherein the lock body is disposed between the lock of the mating housing and the lock projection on the detector when the housing and the mating housing are connected properly and when the detector is at the detection position.

* * * * *